US005271193A

United States Patent [19]

Olsen et al.

[11] Patent Number: 5,271,193

[45] Date of Patent: Dec. 21, 1993

[54] CONCRETE PRODUCTS AND METHODS OF FABRICATION

[76] Inventors: Robert W. Olsen, 15569 Lockmaber Ave., SE, Ft. Myers, Fla. 33912; Stewart M. Dawson, 5210 SW. 11th Place, Cape Coral, Fla. 33914

[21] Appl. No.: 838,865

[22] Filed: Feb. 21, 1992

[51] Int. Cl.[5] ..... E02D 29/12

[52] U.S. Cl. ..... 52/19; 52/21; 52/169.7; 52/309.17; 52/414; 52/431; 52/432; 52/515; 52/245; 52/249

[58] Field of Search ..... 52/19, 21, 169.6, 169.7, 52/309.13, 309.17, 414, 415, 427, 431, 432, 515, 245, 249

[56] References Cited

U.S. PATENT DOCUMENTS

| | | | |
|---|---|---|---|
| 1,463,621 | 7/1923 | Lichtenberg et al. | 52/432 |
| 3,745,738 | 7/1973 | Singer | 52/741 |
| 4,751,799 | 6/1988 | Ditcher et al. | 52/21 |

*Primary Examiner*—Richard E. Chilcot, Jr.
*Assistant Examiner*—Matthew E. Leno

[57] ABSTRACT

An internal form with exterior surfaces corresponding to the interior surfaces of the access chamber adapted to be contacted by corrosive gasses; spraying such exterior surfaces of the form with a release agent and allowing the release agent to cure; spraying the cured release agent with a first layer of gel coat having a first color and allowing the gel coat to cure; spraying the cured first layer of gel coat with a second layer of gel coat having a second color contrasting to the first color and allowing the second layer of gel coat to cure; spraying the cured second layer of gel coat with resin and chopped strands to form a first fiberglass coating; attaching half cylinder pockets to the first fiberglass coating; spraying the first fiberglass coating and pockets with resin and chopped strands to form a second fiberglass coating; rolling the second fiberglass coating to remove air bubbles and to improve the bonding between the layers and coatings; laying up metal reinforcing rods interior of the pockets and spaced from the coating; positioning a wire mesh exterior of the pockets and attaching the rods to the mesh; positioning a jacket as an external form over the internal form; pouring concrete between the internal and external form and into and through the pockets; and removing the forms from the concrete to thereby provide the access chamber component.

7 Claims, 8 Drawing Sheets

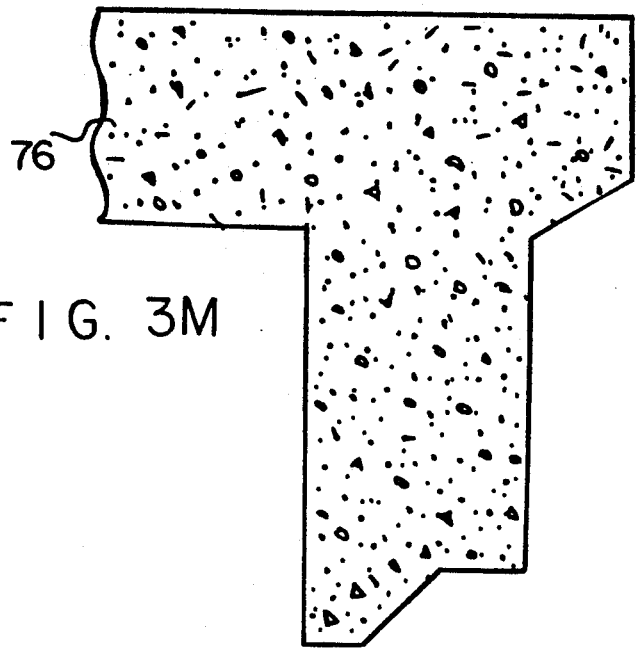
FIG. 3M
FIG. 4
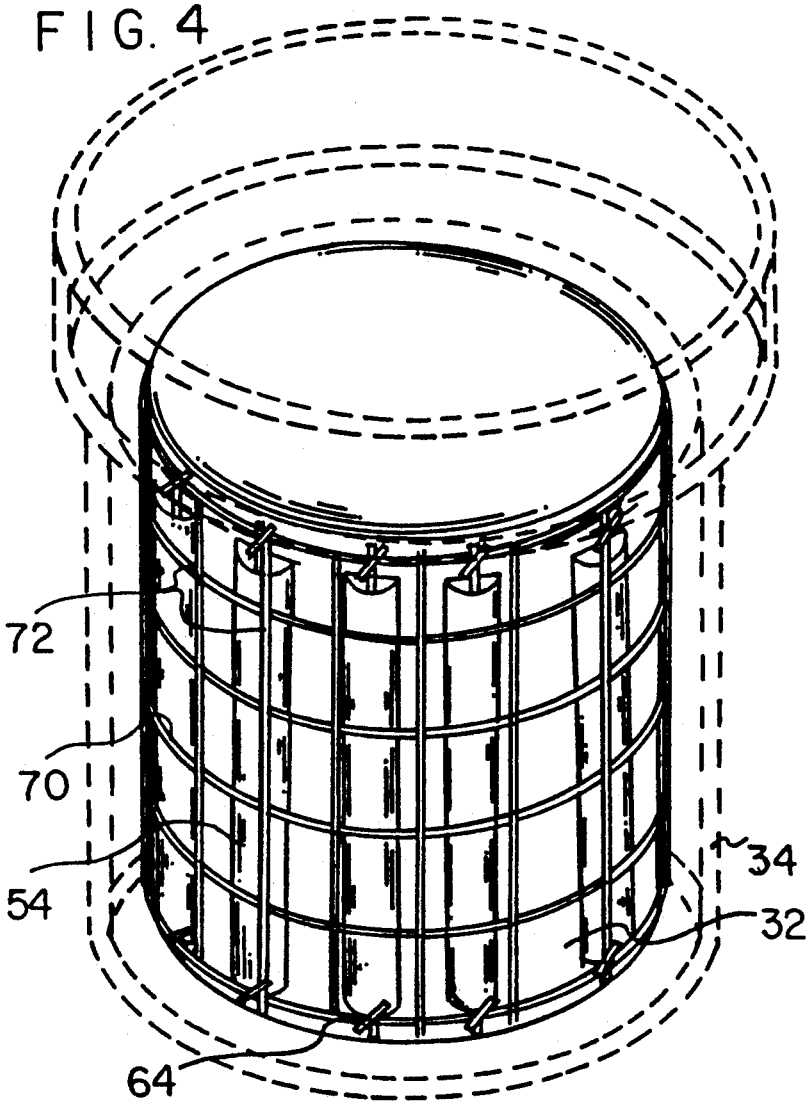

CONCRETE PRODUCTS AND METHODS OF FABRICATION

BACKGROUND OF THE INVENTION

1. Field of the Invention

The present invention relates to concrete products and their methods of fabrication and, more particularly, to concrete manholes, lift stations, and like access chambers having coatings or linings on their surfaces for resisting attack by corrosive gasses.

2. Description of the Background Art

In the past, a plurality of products have been designed and utilized for controlling the movement of sewage fluids therethrough. Such sewage fluids are principally liquids that release corrosive gasses, for example hydrogen sulfide gas, which tend to deteriorate the product through which the fluids flow. The most common of such products are steel reinforced concrete manholes and lift stations. Manholes are those access chambers which initially receive the sewage fluids and then feed them to a lift station from which they are subsequently pumped. The lift station is an access chamber which acts to temporarily store and periodically move the fluids from manholes through force mains to a waste water treatment plant for processing. From the manholes, the fluid is fed by gravity, but at the lift station, submersible pumps compact and move the fluids to the waste water treatment plant. Manholes and lift stations provide access to an underground system of fluid handling.

Known access chambers are generally fabricated solely of concrete. Some are fabricated solely of fiberglass. Access chambers solely of fiberglass are very expensive and lack the necessary strength and weight required for larger applications. Access chambers solely of concrete lack corrosion resistance and, consequently, have short lives. They are, however, of sufficient strength and weight to maintain their position underground during operation and use.

For about the last fifty years it has been a common practice to provide the interior exposed surfaces of access stations with a separate elastomeric sheet to abate corrosion of the concrete by the corrosive gasses of the fluids. The most common material for such liners is polyvinyl chloride, PVC. Unfortunately, such liners are held in place by a T-lock configuration wherein coupling of the liner to the concrete is by spacer mechanical fingers only.

The T-lock configuration for PVC liners creates an inferior product which couples liner to concrete only along spaced lines of their interface. The "T's" are only imbedded a fraction of an inch in the concrete and can easily become dislodged. The present invention has no such deficiencies. In addition, the T-lock configuration requires increased work on-site to trim and heat weld the various component parts to form one integral member. The final product thus has excessive field work required to combine product components. This impairs product performance, performance thus becoming a function of the skill of the field personnel. The present invention is totally made in house with minimized field time, expense and errors.

The present invention comprises a concrete access chamber with corrosion inhibiting and abatement layers integrated with the concrete itself. Such layers include polyester gel coat and glass reinforced polyester resin which are integrally formed on the mold during the fabrication process. All interior layers are laid up on the mold prior to the concrete being poured. This increases accuracy of the various product components with respect to each other and for increased performance of the final product.

The prior art discloses several methods of prohibiting corrosive materials from contacting concrete products by providing the exposed surface with an elastomer to resist corrosion of the concrete. The first method of protecting concrete from corrosive materials employs a corrosive resistant liner that functions as a form for the placement of concrete during the fabrication of a concrete product. By way of example, U.S. Pat. Nos. 3,250,654, 3,532,132 and 3,380,259 to Rubenstein disclose cast-in-place composite reinforced structural material pipe-lines for laying in a trench or similar environment. Subsequent to the formation of the pipe-liner, the liner is placed within a trench to act as a forming means for pipe fabrication whereby a flowable mix of concrete, or similar material, is placed around, about, under and over the pipe liner. In all three patents to Rubenstein the pipe liners are formed by applying a layer of mold release to a mandrel. Then a plurality of forward moving strands or chopped strands are placed in position for spinning in a helical winding. The strands are subsequently wound at a selected helical angle. While the strands of glass fiber are being spun under tension onto the mandrel, a polymer resin composition having a catalyst is applied to the strands of fiber as they are layered upon the mandrel. As the composition reaches the desired state of cure, the pipe-liner is moved forward and removed from the mandrel. Finally, the pipe-liner is then placed within a trench or similar environment. Concrete or other porous material is placed around, about, over and under the pipe-liner to comprise a reinforced concrete pipe-line having corrosion resistant features. In all three disclosures the pipe-liner acts first as a forming means for casting a concrete cover component of the pipe-line and remains in place as a polymerized-polymeric-resin-composition-fiber-reinforced-pipe-liner. Additionally, the pipe-liner and concrete form a mechanical bond with finger-like projections from the exterior surface of the liner's bonding compound that project into the concrete material. The thickness of the concrete layer surrounding the liner and the placement of reinforcement cables within the concrete layer are provided by either rectangular or triangular shaped guides placed on the exterior surface of the pipe-liner.

Chandler et al U.S. Pat. No. 3,439,461; Singer U.S. Pat. No. 3,745,738 and Ditcher et al U.S. Pat. No. 4,751,799 disclose methods of providing plastic liners in concrete manholes. In Chandler et al a method of constructing burial vaults with a composite wall is disclosed. A plastic resinous liner is coated with a strong, wet, tacky adhesive bonding agent prior to concrete being placed on the liner to form a wall component. The concrete and bonding agent cure forming an integral bond between the liner and the concrete. The liner serves as a form or mold for forming the inner concrete wall component thereof. Alternately, Chandler et al discloses that the plastic resinous liner may be a coating that is applied to an existing concrete surface and allowed to cure to form a rigid liner.

In Singer, tubular sections of plastic including a base portion are secured to a conventional concrete slab in a ground hole. The tubular sections are stacked end on end vertically to form a manhole. A hollow shell is placed about the vertically aligned sections and laterally displaced therefrom. Concrete is then poured into the cavity formed by the outer wall of the tubular sections and shell. After the concrete has cured, the outer shell is removed. The plastic liner not only makes the concrete manhole corrosion resistant, but also acts as a form to mold the manhole to a desired configuration. Alternately, Singer discloses a method of spraying or blowing glass reinforced polyester plastic or other similar plastics onto existing structures to obtain corrosion resistance.

In Ditcher, the liners are comprised of a plurality of sections joined together to form the inner surfaces of the manhole and thus providing corrosive resistant surfaces to the concrete product. The liner section defines and forms the inner surface of the manhole being fabricated. Concrete, or similar material, is placed within the mold and allowed to set. The liner material acts to form and support the casting material during the curing process. Since the liner material does not bond naturally to concrete, the liner material engages the concrete by means of integral substantially T-shaped projections which anchor the liner sections to cast members.

A method of extruding and laminating prestressed reinforced concrete pipe is illustrated in Rubenstein U.S. Pat. No. 3,520,749. Polymerizable polymeric resin composition is applied over a mandrel that has been covered with mold release. A resin rich gel coat layer is formed to which glass fiber is applied under tension. The strands are then covered and impregnated with a polymerizable polymeric resin composition to form a pipe-liner. The pipe-liner is then covered with a bonding resin composition in a polymerizable state. Finally, the pipe-liner and mandrel are inserted into an extruder so that polymeric resin composition bonded concrete may be extruded around and about the pipe. The extruder exerts pressure on the concrete and liner to cause the components to bind together.

A second method of protecting concrete from corrosive materials employs a coating or liner material that is applied to an existing concrete product. By way of example, Sergovic U.S. Pat. No. 2,962,052 ; Rubenstein U.S. Pat. No. 3,177,902; Darrow U.S. Pat. No. 3,381,718 and Christensen U.S. Pat. No. 3,984,266 disclose protective materials that are applied to concrete products. In Sergovic, a coating is applied to a concrete pipe to increase wear resistance of the pipe. A polyester-sand coating is applied by means of a spray gun, brush or trowel. The coating may be applied to the exterior or interior of a pipe. The concrete pipe to be coated has a facing layer of a reaction product that is an ethylenically unsaturated alkyd resin and a polymerizable vinyl monomer and a filler. Minimal mechanical bonding takes place between the coating and substrate as a result of minimal surface openings in the concrete available for bonding.

In Rubenstein a method of enhancing the strength features of a porous material is disclosed. The surface, pores and interstices of the surface of porous material are filled and covered with a layer of tough, rubbery reinforcing polymerized resin composition having fiberglass strands under tension embedded with the resin. The resulting surface is more impact resistant to dynamic loading, but does not provide an enhanced surface with improved mechanical bonding between the coating and the substrate.

In Darrow a pipe having a lining material that is resistant to corrosion is disclosed. Two or more plies of a plastic liner are adhered to the inside surface of a concrete pipe. The liner material is backed by a material that is highly susceptible to secure bonding to concrete by a bonding agent. The liner and backing are bonded to the pipe by draping the lining material over an inflatable pneumatic tube assembly which is smaller than the inside diameter of the pipe. Adhesive is applied to the backing material or pipe or both, the tube with the liner draped thereupon are placed within the pipe. Finally, the tube is then inflated to effect contact between the lining and pipe. The disclosure relies on surface bonding between the backing material of the liner and concrete. Due to the limited adhesion available between the concrete surface and the backing material, a good mechanical bond is prohibited.

In Christensen a process for bonding glass reinforced plastic to a ferro-cement product is disclosed. After a ferro-cementious structure has cured, acid is applied to the surface to be protected for effecting etching of the surface. The surface is then rinsed, dried, and a coat of adhesive is applied to the surface. Glass fiber reinforced plastic is applied to the wet adhesive and allowed to cure. The coating results in a structure with improved impact resistance but without a strong mechanical bond between the coating and pipe. This results from minimal surface area available for mechanically bonding of the coating and concrete.

The third method of protecting concrete from corrosive materials is to form a solid structure that is cast with a smooth outer surface. By way of example, Bogue et al U.S. Pat. No. 3,654,018 discloses a structure that has a hard outer surface formed as a fiber-included resin lay-up of a hard material having an inner surface with hooked projections. The hooked projections are created by pulling material from the lay-up and allowing such to droop by gravity. A hardenable aggregate is deposited on the pre-fabricated inner surface which acts as a form for the structure. The aggregate interlocks with the inside surface to create the desired component shape.

None of the known commercial devices or prior patents disclose the present invention. Although many such prior advances are noteworthy to one extent or another, no prior patent or known device teaches or suggests the reliable, convenient and economical concrete products as disclosed herein. As illustrated by a great number of prior patents and devices, efforts are continuously being made in an attempt to more efficiently design, manufacture and utilize manholes, lift stations and the like in an attempt to more efficiently design, manufacture and utilize such product. No prior effort, however, suggests the present inventive combination of component elements arranged and configured as disclosed herein. Prior devices do not provide the benefits attendant with the present invention. The present invention achieves its intended purposes, objects and advantages over the prior art devices and methods through a new, useful and unobvious combination of method steps and component elements, through the use of a minimum number of functioning parts, at a reasonable cost to manufacture, and through the utilization of only readily available material and conventional components.

Therefore, it is an object of the present invention to provide a cost effective manhole/lift station type structure that utilizes a chemical and gas resistant fiberglass liner interwoven mechanically with the concrete and steel reinforcement of an outer structure that provides low cost ballast and strength and that also allows a system that utilizes existing conventional forms and procedures.

It is a further object of the present invention to abate the adverse effects of corrosive gasses on concrete products.

It is a further object of the present invention to extend the life of manholes, lift stations and like access chambers.

It is a further object of the present invention to provide access chambers with the strength of concrete and the corrosion resistance of fiberglass.

It is a further object of the present invention to manufacture superior manholes, lift stations and the like in an efficient, economical manner.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into an improved access chamber component and method of fabricating such access chamber component comprising the steps of providing an internal form with exterior surfaces corresponding to the interior surfaces of the access chamber adapted to be contacted by corrosive gasses; spraying such exterior surfaces of the form with a release agent and allowing the release agent to cure; spraying the cured release agent with a first layer of gel coat having a first color and allowing the gel coat to cure; spraying the cured first layer of gel coat with a second layer of gel coat having a second color contrasting to the first color and allowing the second layer of gel coat to cure; spraying the cured second layer of gel coat with resin and chopped strands to form a first fiberglass coating; attaching half cylinder pockets to the first fiberglass coating; spraying the first fiberglass coating and pockets with resin and chopped strands to form a second fiberglass coating; rolling the second fiberglass coating to remove air bubbles and to improve the bonding between the layers and coatings; laying up metal reinforcing rods interior of the pockets and spaced from the coating; positioning a wire mesh exterior of the pockets and attaching the rods to the mesh; positioning a jacket as an external form over the internal form; pouring concrete between the internal and external form and into and through the pockets; and removing the forms from the concrete to thereby provide the access chamber component.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other methods and structures for carrying out the same purposes of the present invention. It should also be realized by those skilled in the art that such equivalent methods and structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIGS. 3A through 3M are cross sectional views illustrating the steps employed in the manufacture of the concrete product of the present invention whether a manhole, lift station or the like.

FIG. 4 is a perspective view of forms prepared and positioned in accordance with the principles of the present invention and positioned for receiving concrete.

Similar reference characters refer to similar parts throughout the several views of the drawings.

DETAILED DESCRIPTION OF THE PREFERRED EMBODIMENT

Overview

Figure 1:
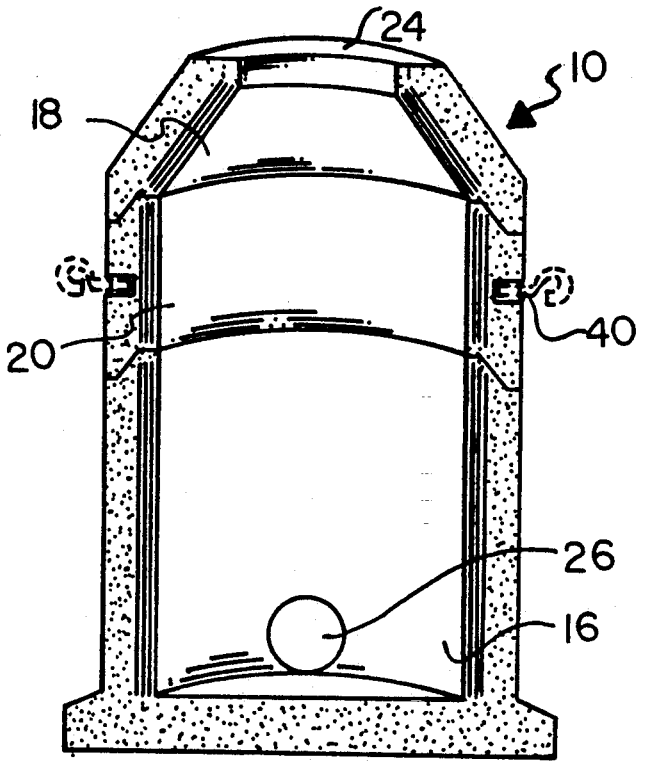
FIG. 1 is a sectional view of a manhole constructed in accordance with the principles of the present invention.

The product itself, whether a manhole 10, lift station 12 or other access chamber, can well be understood with reference to its method of manufacturing. The method of manufacturing may be considered as carried out in 13 steps.

By way of example, for manholes there would be a bottom component called the base section 16, a top component called the cone 18, and in the middle are one or a plurality of intermediate components called risers 20. When these components are assembled on site, they will form the final manhole. Lift stations would be of the same type of design and involve essentially the same manufacturing process. The top of the lift station, however, would normally be a flat component 24 as compared with a cone. Various of these components are provided with holes or apertures 26 to couple with pipes for providing a flow of fluids into and out of the access chamber.

Step #A

A steel mold or form 30 is initially provided as the internal member. In actuality, there will be a plurality of steel forms, one corresponding to the shape of the exterior surfaces of each individual component of the final product. The forms which are utilized are fabricated of rolled steel which is standard within the industry today for conventional concrete forms. The forms include an interior core form 32 and an exterior jacket form 34 and, where needed, a top form and/or a bottom form. Together they define therebetween the shape of the final product component.

Figure 2:
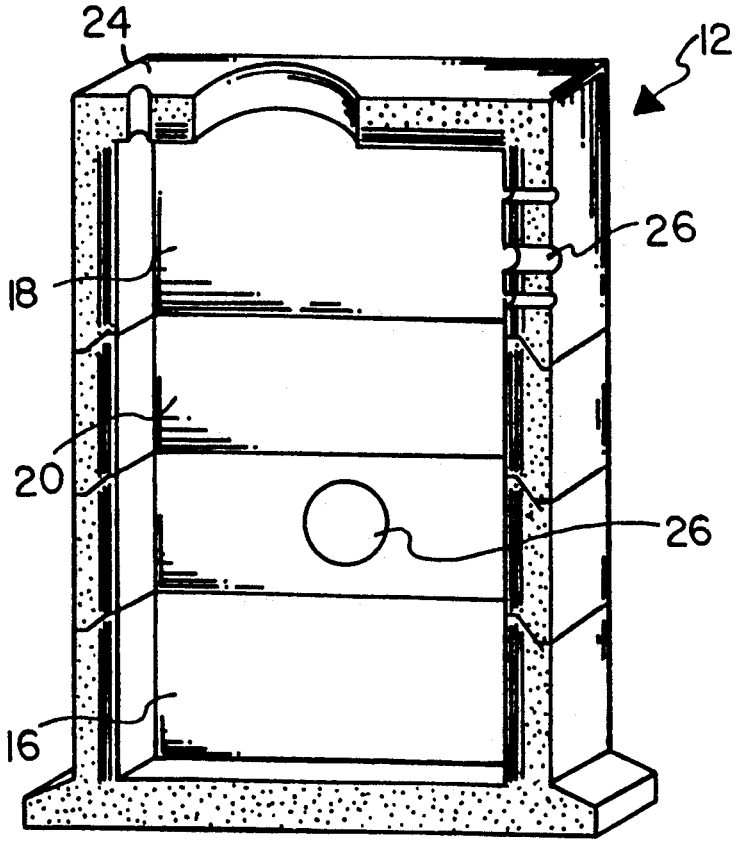
FIG. 2 is a sectional view of a lift station constructed in accordance with the principles of the present invention.

Note is taken that the manhole and lift station of FIGS. 1 and 2 show such products in an orientation for use. The other Figures show such products and components and forms inverted, the orientation in which manholes and certain lift stations occur during their fabrication.

Step #B

The exterior surface of the core forms 30 are then coated, preferably by spraying, with a fiberglass release agent 38 to facilitate separation of the form and gel coat layer on the concrete after setting. The release agent is spray-painted on all exterior surfaces of the forms corresponding to those surfaces of the concrete to be contacted by the transported fluid and their associated corrosive gasses. A preferred release agent is PVA which stands for poly vinyl alcohol, a product of Rexco, Corporation, Part All #10 or any other material which has the capability of allowing separation of fiberglass and form when located therebetween.

The release agent is preferably sprayed in one coat to a thickness of about 4 miles. Curing time is about 15 to 30 minutes.

In an alternate embodiment of the invention, the release agent could be wax. A typical preferred wax is Rexco, Corporation, Part All #2. Other waxes which could be utilized include TR—Mold Release and McGuires Mold Release. When using the wax, it would be put on with one or a plurality of layers depending on the quality of the final product for a particular application. The residual release agent would preferably be washed off after fabrication prior to shipment.

Any release agent normally has some residue also sticking to the form. Such residue might by retained and used during the fabrication of the next part. After a certain number of molding processes, however, all residue release agent would be totally washed away and a new release agent applied.

The header and plate, inside and outside horizontal surfaces, are also coated with a similar release agent. The header is the upper or male segment of a tongue and groove coupling. The plate is generally the radially exterior or shallower portion of the tongue and groove section. Together the tongue will mate with a groove of an adjacent component while the groove will mate with a tongue of such adjacent component to make a tight coupling between the various components.

This process step also includes coating the hole formers with the release agent. The hole formers are those portions of the form corresponding to the location where pipes will be coupled to the concrete through rubber compression boots in a conventional manner. A compression boot is a tubular elastomeric member received interior of the hole of a component adapted to receive a pipe interiorly thereof. Appropriate metal straps or bands secure the pipe and hole through the boot. A first compression type band is located interior of the boot within the hole. A second adjustable band or strap is located on the exterior surface of the boot outside the hole over the pipe. The bands function together to secure the pipe to the boot and the boot to a hole of the access chamber.

During the application process for the release agent, as well as for the gel coat and glass reinforced resin, the horizontal portion of the modified bell and spigot joint of the form, those areas corresponding to the tongue and groove, are also lined along with the entry pipe holes. The pipe holes 26 are applied up to at least the halfway point where the sealing band of the compressor boot would be installed.

There is no full penetration through a lift station wall of any lifting holes. The lift holes 40 are formed partially into the concrete by the exterior form, i.e., the jacket.

Step #C

Alternating gel coat layers 44 and 46 are then sprayed over the cured release agent of the forms. These will preferably be of two different contrasting colors. The use of two different contrasting colors allows a method of abrasion to be used to field check that two layers were used. This would be done by abrading in a small test area through the first layer that would expose the second layer of gel coat. Gel coat is a hardenable polymeric fluid material, commercially available, adapted to form a corrosion resistant layer on the surfaces of the access chamber exposed to corrosive materials.

This step, the application of the gel coat, is effected after the curing of the release agent. This is initiated by the spraying of a resin, preferably an isophthalic polyester gel coat to all areas treated with the release agent which might be contacted by corrosive gasses. This will end up being the exposed layer of the finished component, the face to inhibit and abate corrosion of the concrete and to be resistant from the chemical attack of the gasses. The thickness of the first gel coat layer is preferably between about 20 and 25 mills.

Step D

After the first layer 44 of gel coat has cured or tacked, approximately 30 minutes at ambient conditions, a second layer of gel coat is sprayed over the first layer. The second layer is the same as the first in composition and area of application. It is, however, of a contrasting color. In this manner, a visual inspection allows a determination as to whether such coats are still in place for protecting the concrete. If scratched, appropriate repair may be effected. The thickness of this second coat is preferably between about 20 and 25 mills.

Step E

After the second gel coat layer 46 cures or tacks, a layer or coating 50 of chopped fiberglass strands and a resin, preferably isophthalic polyester resin, are applied by concurrent spraying. This creates the fiberglass liner which is a key constituent of the end product. When being sprayed, fiberglass strand is periodically chopped and intermixed with the liquid resin being sprayed. This strand/resin layer or coating 50 is then thoroughly rolled as by a fiberglass lamination roller or the like. The roller is a bubble buster to expel any air bubbles therein. In addition, a second layer of chopped strands and resin is applied over the first layer after it has become tacky, between about 10 and 20 minutes.

With regard to the fiberglass/resin layer coated over the gel coat, these two products have a natural affinity, one for another since both are polyester resin based. They will have a tight chemical bonding as is used in many industries. Consider in particular the boat building industry.

Step #F

After the fiberglass/resin layer has tacked, between about 10 and 20 minutes, half sections of four inch diameter tube, i.e., PVC, other plastic or cardboard, is utilized as a tube form or pocket 54 and attached to the fiberglass/resin coating to create a mechanical "U-type" bond between the concrete and the liner. These are spaced approximately 19 inches apart vertically along the circumference of the liner. The length of the tube would vary depending upon the length of the section being cast. The tube or pocket preferably extends from approximately six inches above the bottom of the section and six inches below the top of the section. They would be held temporarily in place with glue or bound by wire.

These pockets 54 create zones for the further mechanical bonding of the concrete to the layers of fiberglass and, hence, the gel coat. The use of PVC pipe half sections is preferred for the bonding agent. These pockets are tubes, centrally cut along their axis to form half tubes, with semicircular cross sections. They are open at the top and bottom so that concrete can flow therein and therethrough. They are in contact with the fiberglass at their straight edges and positioned into intimate contact with the fiberglass/resin layer.

Although PVC is disclosed as the preferred material for the mechanical pocket molds, other materials, as for example cardboard or other plastics, etc., could readily be utilized.

Step G

After the placing of the pocket molds, a supplemental layer 56 of fiberglass/resin is sprayed over the pockets in such manner that the sprayed material will go into and out of and around the pockets. As such, the concrete will make an integral construction and good mechanical bond throughout the system. The supplemental layer of glass reinforced resin is applied which additionally reinforces a portion of the area of the liner between the pockets, and by being applied over the tubes creates a U-type locking mechanism. The pockets described above act only as a form for the creation of the strength imparting U. The fiberglass reinforced resin applied over the pockets bonds to the first application, thus creating an integral piece over the forms.

Step H

The glass reinforced resin layers or coatings are then thoroughly rolled, as by hand roller 58, to expel air bubbles and to create this bonding effect within the resin layers or coatings.

The bonding is between the gel coat on the form, the fiberglass and pockets as an intermediate part, and the concrete as the exterior part. When rolling out the fiberglass, the intention is to eliminate the air bubbles formed during spraying for increased strength and to eliminate the possibility of delamination.

Step I

After this layer or coating has cured, rods or rebars 62, preferably standard No. 4, are placed inside of the U of the pockets and tied top, bottom, and every 6 inches therebetween with tie wires 64 to wire mesh 66 therearound, preferably conventional ASTM C-478, for reinforcement. These rods or rebars 62 act to reinforce the inside of the pocket and to enhance the mechanical bond between the liner, the concrete and the concrete reinforcement.

Step #J

Reinforcement is then provided by a gridwork of steel wire bars, reinforcing mesh 66, preferably, to ASTM C-478 Specs. The bars are placed around the fiberglass core approximately at the middle ⅓ of the required concrete wall thickness. The grid mesh work includes horizontal bars 70 and vertical bars 72 in contact at cross over points where they are coupled together.

Step #K

After the prior steps are completed and the last layer of the liner has sufficiently cured, approximately one hour after application, the jacket or outer form 34 is attached. In the disclosed preferred embodiment of FIGS. 3A through 3M, the forms are inverted with respect to their position during use. There is no lower form (FIGS. 1 and 2) since the base at the upper location (FIGS. 3 and 4) is flat. Such base has reinforcing rods throughout.

Lastly, for intermediate and upper components of an access chamber, a lower form would also be utilized to create the appropriate tongue and grooves. Here again the concrete-contacting surfaces thereof would be treated with a release agent, gel coat and fiberglass similar to the other treated surfaces of the component as discussed above.

Figure 3A:
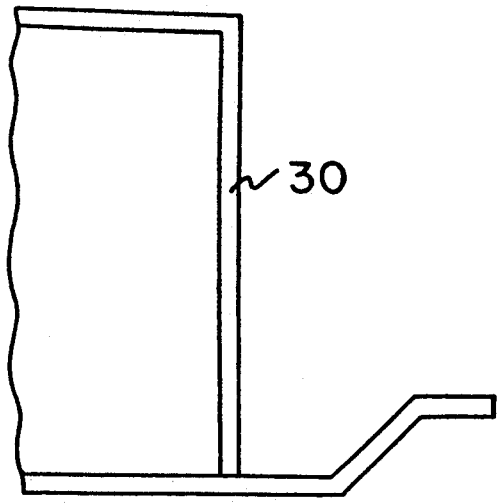
Figure 3B:
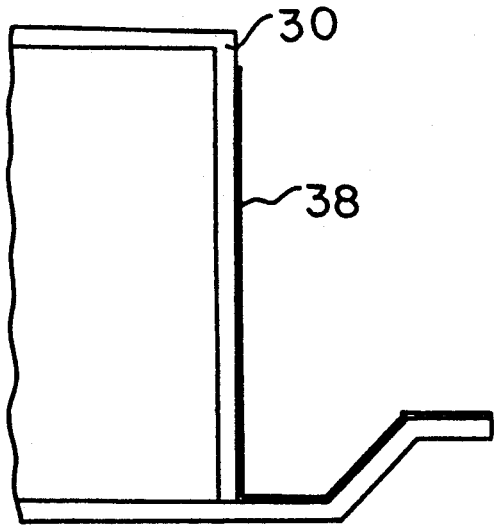
Figure 3C:
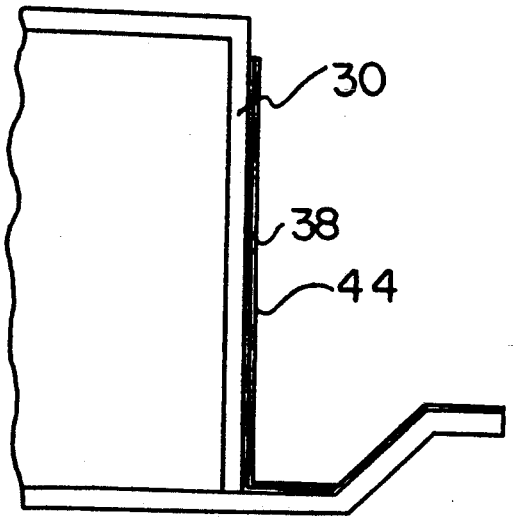
Figure 3D:
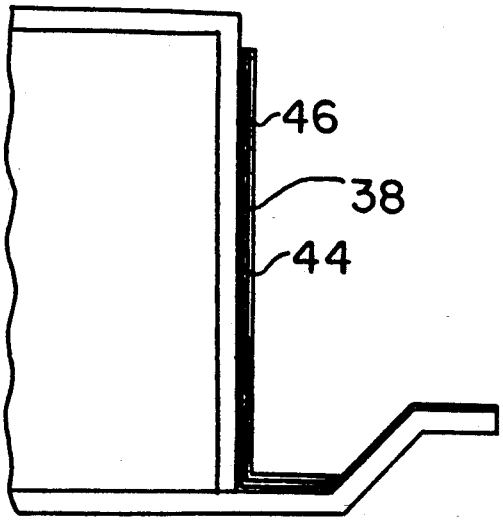
Figure 3E:
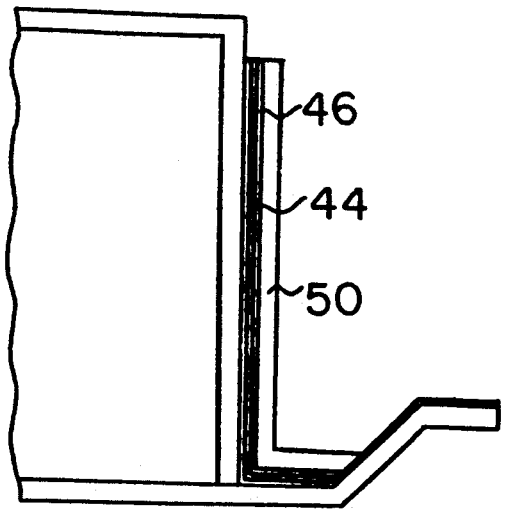
Figure 3F:
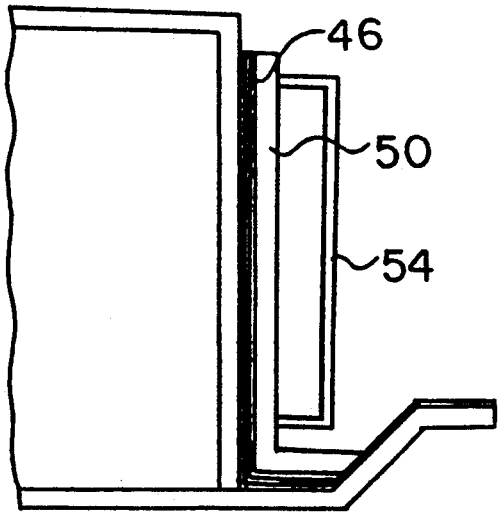
Figure 3G:
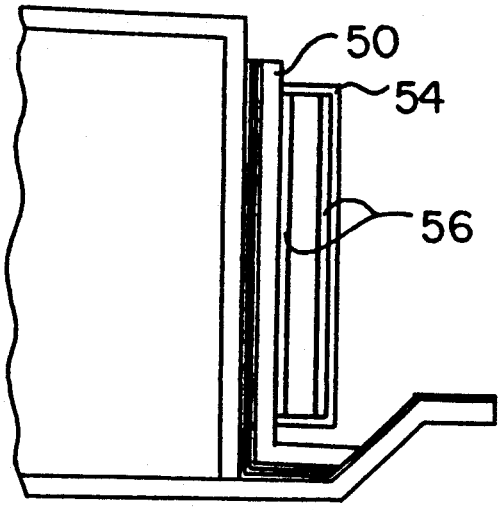
Figure 3H:
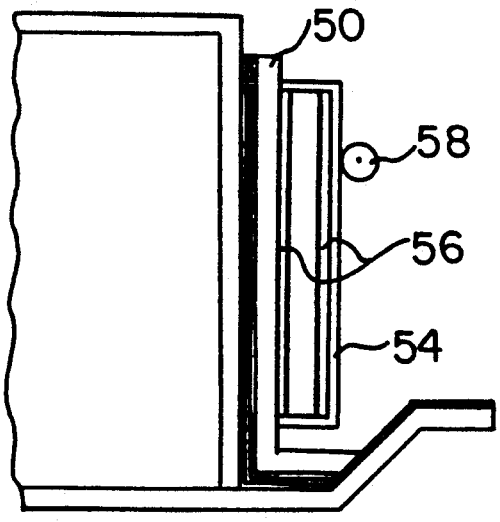
Figure 3I:
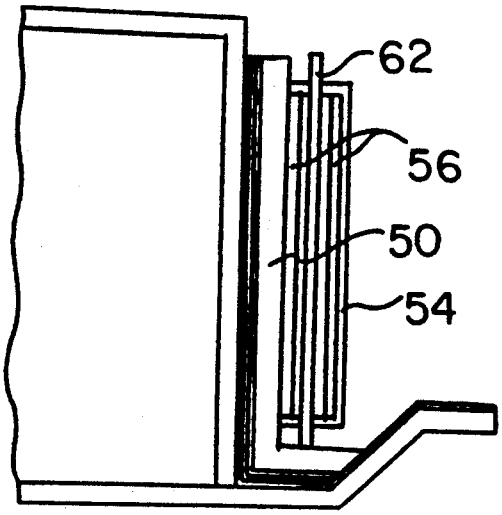
Figure 3J:
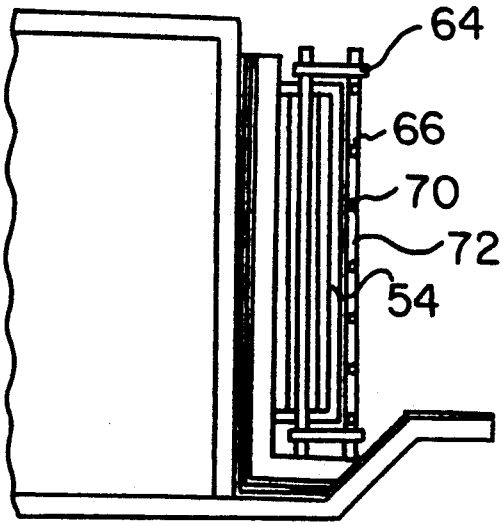
Figure 3K:
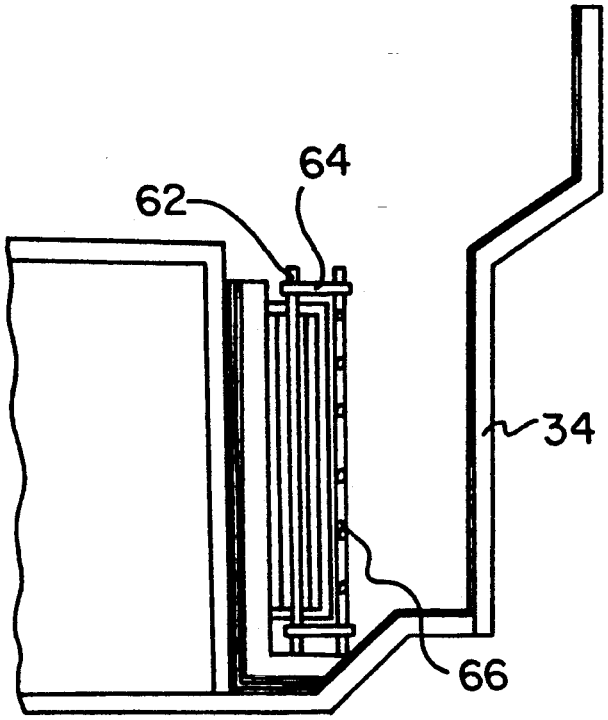
Figure 3L:
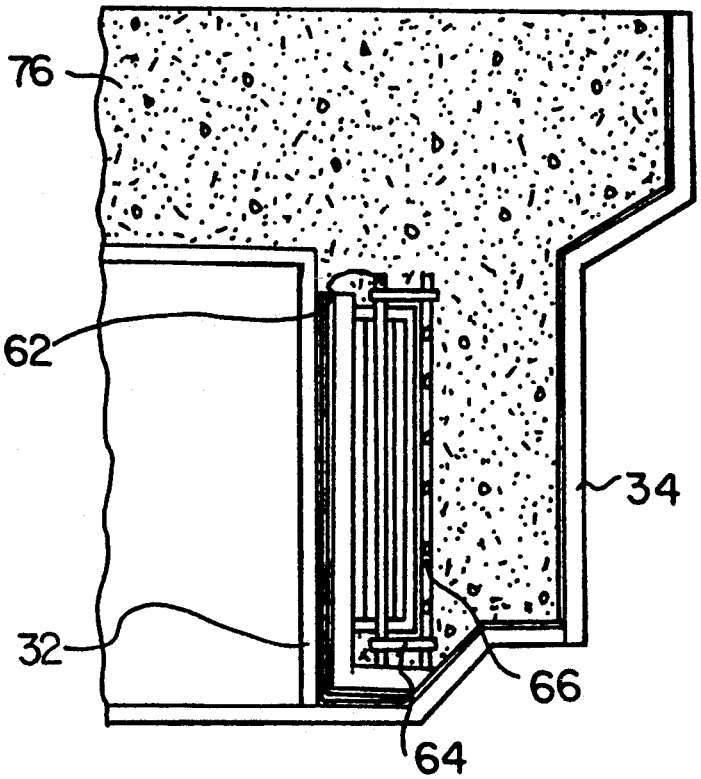

In the showings of FIGS. 3K and 3L, the pockets and related elements are shown greatly enlarged with respect to the concrete product to better illustrate their internal constructions.

Step #L

Concrete 76 is then poured into the form and thoroughly vibrated to fill all internal voids in the conventional manner. The maximization of the mechanical bond is furthered by the use of the pockets which are likewise covered with the fiberglass.

Step #M

After an extended period of time, after the concrete has cured, the forms 32 and 34 would be stripped and the finished product is ready for delivery. The contractor would install the sections conventionally using a mastic such as "Ramnek", in two separate layers, one to squeeze out to the inside of the manhole and one to squeeze out to the outside of the manhole. This provides a watertight seal that protects the unlined portion of the joint from gas attack from the inside and from outside water being allowed to enter from the outside. The compression band of the pipe boot applied halfway over the liner and halfway over the unlined concrete at the pipe entry voids would provide the same protection.

Product

The final product is then created or formed of concrete with surfaces to be contacted by corrosive gasses being provided with layers of gel coat and layers of fiberglass. Such surfaces would otherwise be corroded by the corrosive gasses attendant with such fluids. A small degree of release agent may remain on the final product but could be washed off prior to installation and use. Similarly, some release agent will also remain on the forms. Such release agent may be retained there for a plurality of uses of the form. Periodically, however, such release agent are washed from the form to remove any contaminants which might have come there during operation and use.

The final product is a concrete access chamber, manhole or lift station, formed of components. The access chamber components each comprise a main body portion of concrete. Two layers of contrasting colors of corrosion resistant gel coat are located over the surfaces of the concrete to be contacted by liquid and corrosive gasses associated therewith. This allows easy visual detection of nicks or cuts in the corrosion resistant layers. An intermediate coating of fiberglass is formed between the concrete and exterior layer. A plurality of pockets are positioned within the main body portion. A supplemental coating of fiberglass is formed over the product including the pockets. Rebars are then positioned within the pockets with wire mesh thereadjacent and with attachment means therebetween. As a result, the concrete extends over the rebars and wire mesh and over and through the pockets to form a single integral component.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of structures and the combination and arrangement of parts may be resorted to without departing from the spirit and scope of the invention.

Now that the invention has been described,

What is claimed is:

1. An access chamber component comprising:

a main body portion of concrete;

an exterior layer of corrosion resistant material over the surfaces of the concrete thereof to be contacted by liquid and corrosive gasses associated therewith;

an intermediate layer of fiberglass between the concrete and exterior layer; and a plurality of pockets located within the main body portion of concrete and coupled to said intermediate layer of fiberglass.

2. The access chamber component as set forth in claim 1 wherein the exterior layer is gel coat.

3. The access chamber component as set forth in claim 1 wherein the exterior layer is two layers of contrasting colors.

4. The access chamber component as set forth in claim 1 and further including a supplemental layer of fiberglass over the intermediate layer of fiberglass and the plurality of pockets.

5. The access chamber component as set forth in claim 4 and further including rebars within the pockets and wire mesh thereadjacent with attachment means therebetween.

6. The access chamber component as set forth in claim 5 wherein the concrete extends over the rebars and wire mesh and over and through the pockets to form a single integral component.

7. An access chamber component comprising:

a main body portion of concrete;

two layers of contrasting colors of corrosion resistant gel coat over the surfaces of the concrete thereof to be contacted by liquid and corrosive gasses associated therewith;

an intermediate coating of fiberglass between the concrete and two layers of gel coat;

a plurality of pockets located within the main body portion of concrete and coupled to the intermediate coating of fiberglass;

a supplemental coating of fiberglass over the pockets; and rebars extending through the pockets and wire mesh exterior of the pockets with attachment means coupling the rebar and wire mesh exterior of the pockets whereby the concrete extends over the rebars and wire mesh and over and through the pockets to form a single integral component.

* * * * *